US010373606B2

(12) United States Patent
Ashikawa et al.

(10) Patent No.: US 10,373,606 B2
(45) Date of Patent: Aug. 6, 2019

(54) TRANSLITERATION SUPPORT DEVICE, TRANSLITERATION SUPPORT METHOD, AND COMPUTER PROGRAM PRODUCT

(71) Applicant: KABUSHIKI KAISHA TOSHIBA, Tokyo (JP)

(72) Inventors: Taira Ashikawa, Kanagawa (JP); Kosei Fume, Kanagawa (JP); Yuka Kuroda, Kanagawa (JP); Yoshiaki Mizuoka, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 15/417,650

(22) Filed: Jan. 27, 2017

(65) Prior Publication Data

US 2017/0140749 A1 May 18, 2017

Related U.S. Application Data

(63) Continuation of application No. PCT/JP2015/058924, filed on Mar. 24, 2015.

(51) Int. Cl.
*G10L 13/08* (2013.01)
*G10L 13/10* (2013.01)
(Continued)

(52) U.S. Cl.
CPC ..... *G10L 13/10* (2013.01); *G10L 13/0335* (2013.01); *G10L 13/047* (2013.01)

(58) Field of Classification Search
None
See application file for complete search history.

(56) References Cited

U.S. PATENT DOCUMENTS 5,983,184 A 11/1999 Noguchi
6,115,686 A * 9/2000 Chung ..... G10L 13/08 704/260

(Continued)

FOREIGN PATENT DOCUMENTS

JP 10-78952 3/1998
JP 11-327870 11/1999

(Continued)

OTHER PUBLICATIONS

International Search Report issued by the Japanese Patent Office in International Application No. PCT/JP2015/058924, dated Jun. 16, 2015, 6 pages.

*Primary Examiner* — Abul K Azad
(74) *Attorney, Agent, or Firm* — Finnegan, Henderson, Farabow, Garrett & Dunner, L.L.P.

(57) ABSTRACT

A transliteration support device according to an embodiment includes an acquisition unit, an extraction unit, a generation unit, and a reproduction unit. The acquisition unit acquires a text to be transliterated. The addition unit adds a transliteration tag indicating a transliteration setting of the text to the text. The extraction unit extracts a transliteration pattern in which a frequent appearance transliteration setting frequently appearing in the transliteration settings indicated by the transliteration tags and an applicable condition when the frequent appearance transliteration setting is applied to the text are in association with each other. The generation unit produces a synthesized voice using the transliteration pattern. The reproduction unit reproduces the produced synthesized voice.

9 Claims, 12 Drawing Sheets

(51) Int. Cl.
*G10L 13/033* (2013.01)
*G10L 13/047* (2013.01)

(56) References Cited

U.S. PATENT DOCUMENTS

| | | | | |
|---|---|---|---|---|
| 6,397,183 | B1 | 5/2002 | Baba et al. | |
| 8,612,206 | B2 * | 12/2013 | Chalabi | G06F 17/2863 704/8 |
| 2012/0041751 | A1 * | 2/2012 | Elfeky | G06F 17/2223 704/2 |
| 2014/0278350 | A1 * | 9/2014 | Scriffignano | G06F 17/2872 704/8 |
| 2015/0170635 | A1 * | 6/2015 | Fleizach | G10L 13/043 704/260 |
| 2017/0004822 | A1 | 1/2017 | Fume et al. | |

FOREIGN PATENT DOCUMENTS

| | | |
|---|---|---|
| JP | 2005-266009 | 9/2005 |
| JP | 2007-128506 | 5/2007 |
| JP | 5423466 | 2/2014 |
| JP | 2014-222542 | 11/2014 |
| WO | WO 2015/162737 | 10/2015 |

* cited by examiner

```
<body>
  <h1>1. INFORMATION</h1>
  <div>IN THE NEXT MEETING…</div>
  <span>*IMPORTANT: IF YOU ARE ABSENT, PLEASE CONTACT THE
FOLLOWING</span>
  <h1>2. CONTACT INFORMATION</h1>
  <div>
  TELEPHONE NUMBER IS 012-345-****
  CELLULAR PHONE NUMBER IS 090-1234-****
  URL IS http://www.***.co.jp
  </div>
  <div>
  2014 (HEISEI 26) YEAR 8 MONTH 4 DAY
  </div>
  <h1>3. AGENDA </h1>
  <h1>4. SCHEDULE</h1>
</body>
```

FIG.6

```
<body>
  <h1 x-audio-param="B,+10,+3">1. INFORMATION</h1>
  <div x-audio-param="A,+5,+5">IN THE NEXT MEETING...</div>
  <span style="bold;"  x-audio-param="A,+10,+5">*IMPORTANT...</span>
  <h1 x-audio-param="B,+10,+3">2. CONTACT INFORMATION</h1>
  <div x-audio-param="A,+5,+5">
  TELEPHONE NUMBER IS 012<span x-audio-pause></span>-345<span x-
audio-pause></span>-****
  CELLULAR PHONE NUMBER IS 090<span x-audio-pause></span>
-1234<span x-audio-pause></span>-****
  <span x-audio-ruby ="YU-ARU-ERU">URL </span>IS
http://www.*<span x-audio-pause></span>*<span x-audio-
pause></span>s<span x-audio-pause></span>*<span x-audio-
pause></span>*<span x-audio-pause></span>.co.jp
  </div>
  <div x-audio-param="A,+5,+5">
  2014<span x-audio-ruby =">(HEISEI 26) </span>YEAR 8 MONTH 4 DAY
  </div>
  <h1>3. AGENDA </h1>
  <h1>4. SCHEDULE</h1>
</body>
```

FIG.9

| APPLICABLE CONDITIONS | TRANSLITERATION SETTINGS |
|---|---|
| ELEMENT NAME IS <h1> | SPEAKER IS MR. B, VOLUME IS +5, PITCH IS -2 |
| ELEMENT NAME IS  | VOLUME IS +5 |
| TEXT IS TELEPHONE NUMBER STYLE TEXT | ADD THE PAUSE TAG BEFORE HYPHEN (-) AND THE READING TAG OF "NO", WHICH IS THE READING OF HYPHEN (-) |
| TEXT IS URL STYLE TEXT | ADD THE PAUSE TAG BETWEEN [ALPHANUMERIC CHARACTERS] BETWEEN [http://www.] AND [.co.jp] |
| TEXT IS [NUMERICAL VALUE] (HEISEI[NUMERICAL VALUE]) YEAR | ADD THE READING TAG WHOSE READING IS A NULL CHARACTER STRING (IS NOT READ) TO (HEISEI[NUMERICAL VALUE]) |

FIG.12

| TRANSLITERA-TION TAG ID | TRANSLITERATION INFORMATION | TRANSLITERATION TAG UPDATE TIME |
|---|---|---|
| 1 | (1) x-audio-param="B,+10,+3"<br>(2) x-audio-param="B,+10,+1"<br>(3) x-audio-param="B,+10,+3" | (1) 00:00:05,<br>(2) 00:00:15,<br>(3) 00:00:30 |
| 2 | (1) x-audio-param="B,+10,+3"<br>(2) x-audio-param="B,+10,+2"<br>(3) x-audio-param="B,+10,+1" | (1) 00:00:40<br>(2) 00:00:45<br>(3) 00:00:50 |
| 3 | (1) x-audio-param="B,+10,+1"<br>(2) x-audio-param="B,+10,+3" | (1) 00:01:00,<br>(2) 00:01:10 |

TRANSLITERATION SUPPORT DEVICE, TRANSLITERATION SUPPORT METHOD, AND COMPUTER PROGRAM PRODUCT

CROSS-REFERENCE TO RELATED APPLICATIONS

This application is a continuation of PCT International Application No. PCT/2015/058924, filed on Mar. 24, 2015; the entire contents of which are incorporated herein by reference.

FIELD

Embodiments of the present invention relate to a transliteration support device, a transliteration support method, and a computer program product.

BACKGROUND

Conventionally, when a text is converted into voices, a translation work has been efficiently performed using transliteration support devices. Specifically, when editing a text serving as a voice synthesis target, the conventional transliteration support device first performs morpheme analysis and produces phonetic character strings for each of the texts before and after editing. The conventional transliteration support device, then, determines whether the text is edited for modifying readings or accents of the synthesized voices on the basis of the morpheme analysis result.

When it is determined that the text is edited for modifying readings or accents of the synthesized voices, the conventional transliteration support device produces editing history data indicating the editing content and stores it in a storage unit. When an error in voice is pointed out by an operator, the conventional transliteration support device searches the editing history data for the editing content of the text editing that should be performed for the modification. When the editing content has been found, the conventional transliteration support device automatically re-edits the text.

In the conventional transliteration support technology, the text that is the same as the text modified in the past, which is indicated by the editing history data stored in the storage unit, is the target of the modification. The conventional transliteration support device, thus, needs to repeat the modification of similar readings, accents, pausing positions, or voice synthesis parameters. As a result, a problem arises in that it is difficult to efficiently perform transliteration work.

BRIEF DESCRIPTION OF DRAWINGS

FIG. 6 is a diagram illustrating exemplary texts to which transliteration tags are added by the transliteration support device in the first embodiment.

FIG. 9 is a diagram illustrating examples of combinations of applicable conditions and the transliteration settings in respective transliteration patterns.

FIG. 12 is a diagram illustrating exemplary transliteration history data used by the transliteration support device in the second embodiment.

DETAILED DESCRIPTION

A transliteration support device according to an embodiment includes an acquisition unit, an extraction unit, a generation unit, and a reproduction unit. The acquisition unit acquires a text to be transliterated. The addition unit adds a transliteration tag indicating a transliteration setting of the text to the text. The extraction unit extracts a transliteration pattern in which a frequent appearance transliteration setting frequently appearing in the transliteration settings indicated by the transliteration tags and an applicable condition when the frequent appearance transliteration setting is applied to the text are in association with each other. The generation unit produces a synthesized voice using the transliteration pattern. The reproduction unit reproduces the produced synthesized voice.

The following describes embodiments of a transliteration support device in detail with reference to the accompanying drawings.

First Embodiment

A transliteration support device in a first embodiment is used for making an electronic book (such as an audio book or DAISY standard data) including texts and synthesized voices corresponding to the texts, for example. DAISY is the abbreviation of "digital accessible information system". The transliteration work described below means work that produces the synthesized voices corresponding to the input texts and modifies readings, accents, pauses, or the like of the produced synthesized voices.

Structure of First Embodiment

Figure 1:
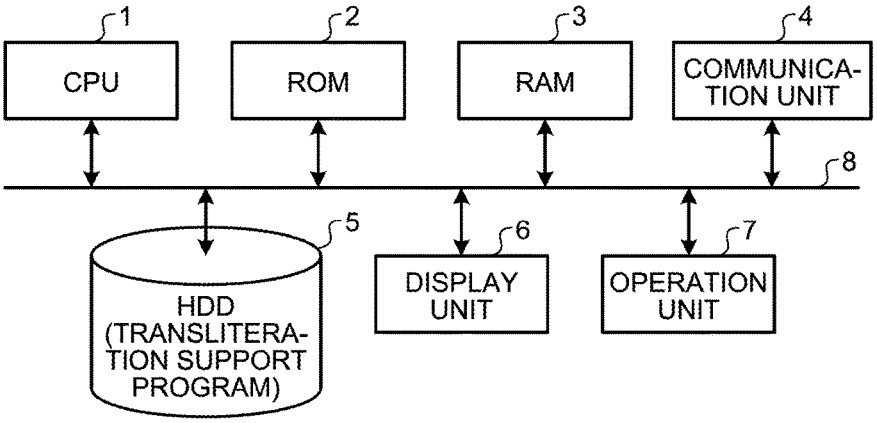
FIG. 1 is a hardware structural diagram of a transliteration support device in a first embodiment.

FIG. 1 is a block diagram of the transliteration support device in the first embodiment. For example, the transliteration support device according to the embodiment can be achieved by what is called a personal computer. The manner to achieve the transliteration support device is not limited to this example. The transliteration support device according to the embodiment may be achieved by another device. In this example, as illustrated in FIG. 1, the transliteration support device includes a CPU 1, a ROM 2, a RAM 3, a communication unit 4, an HDD 5, a display unit 6, and an operation unit 7. The CPU 1, the ROM 2, the RAM 3, the communication unit 4, the HDD 5, the display unit 6, and the operation unit 7 are coupled to one another via a bus line 8.

CPU is the abbreviation of "central processing unit". ROM is the abbreviation of "read only memory". RAM is the abbreviation of "random access memory". HDD is the abbreviation of "hard disk drive".

The HDD 5 stores therein a transliteration support program. The CPU 1 develops respective units achieved by the transliteration support program, which is described with reference to FIG. 2, and executes a transliteration support operation. In this case, the transliteration support program is stored in the HDD 5. The transliteration support program, however, may be stored in another storage unit such as the ROM 2 or the RAM 3.

Figure 2:
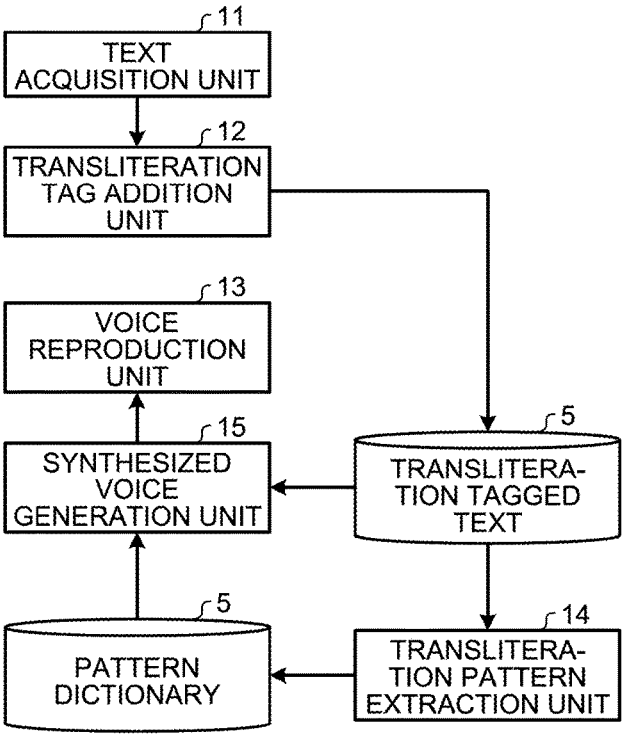
FIG. 2 is a functional block diagram of the transliteration support device in the first embodiment.

FIG. 2 illustrates a functional block diagram of respective functions achieved by a result of the CPU 1 executing the transliteration support program stored in the HDD 5. As illustrated in FIG. 2, the CPU 1 functions as a text acquisition unit 11, a transliteration tag addition unit 12, a voice reproduction unit 13, a transliteration pattern extraction unit 14, and a synthesized voice generation unit 15 as a result of the execution of the transliteration support program.

The text acquisition unit 11 is an example of the acquisition unit. The transliteration tag addition unit 12 is an example of the addition unit. The voice reproduction unit 13 is an example of the reproduction unit. The transliteration pattern extraction unit 14 is an example of the extraction unit. The synthesized voice generation unit 15 is an example of the generation unit.

The text acquisition unit 11 acquires a text. The voice reproduction unit 13 instructs the synthesized voice generation unit 15 to produce a synthesized voice in response to the operator's instruction. The voice reproduction unit 13 reproduces the synthesized voice (voice data) produced by the synthesized voice generation unit 15. The transliteration tag addition unit 12 produces a transliteration tagged text in which a transliteration tag is added to the acquired text, and stores the transliteration tagged text in the storage unit such as the HDD 5 (or the RAM 3).

The transliteration pattern extraction unit 14 extracts a transliteration pattern, which is described later, using the transliteration tag, and stores the transliteration pattern in the storage unit such as the HDD 5 (or the RAM 3). The synthesized voice generation unit 15 produces the synthesized voice corresponding to the text using the text, the transliteration tag, and the transliteration pattern.

In this example, the text acquisition unit 11, the transliteration tag addition unit 12, the voice reproduction unit 13, the transliteration pattern extraction unit 14, and the synthesized voice generation unit 15 are achieved by software. A part or all of the text acquisition unit 11, the transliteration tag addition unit 12, the voice reproduction unit 13, the transliteration pattern extraction unit 14, and the synthesized voice generation unit 15 may be achieved by hardware.

The transliteration support program may be recorded and provided on a computer-readable recording medium such as a CD-ROM, and a flexible disk (FD), as an installable or executable file. The transliteration support program may be recorded and provided on a computer-readable recording medium such as a CD-R, a DVD, a blue-ray disc (registered trademark), and in a semiconductor memory. DVD is the abbreviation of digital versatile disc. The transliteration support program may be provided via a network such as the Internet. The transliteration support device may download the transliteration support program via the network, and install and execute the transliteration support program in the storage unit such as the HDD 5. The transliteration support program may be embedded and provided in the storage unit such as the ROM 2 of the transliteration support device.

Transliteration Support Operation

Figure 3:
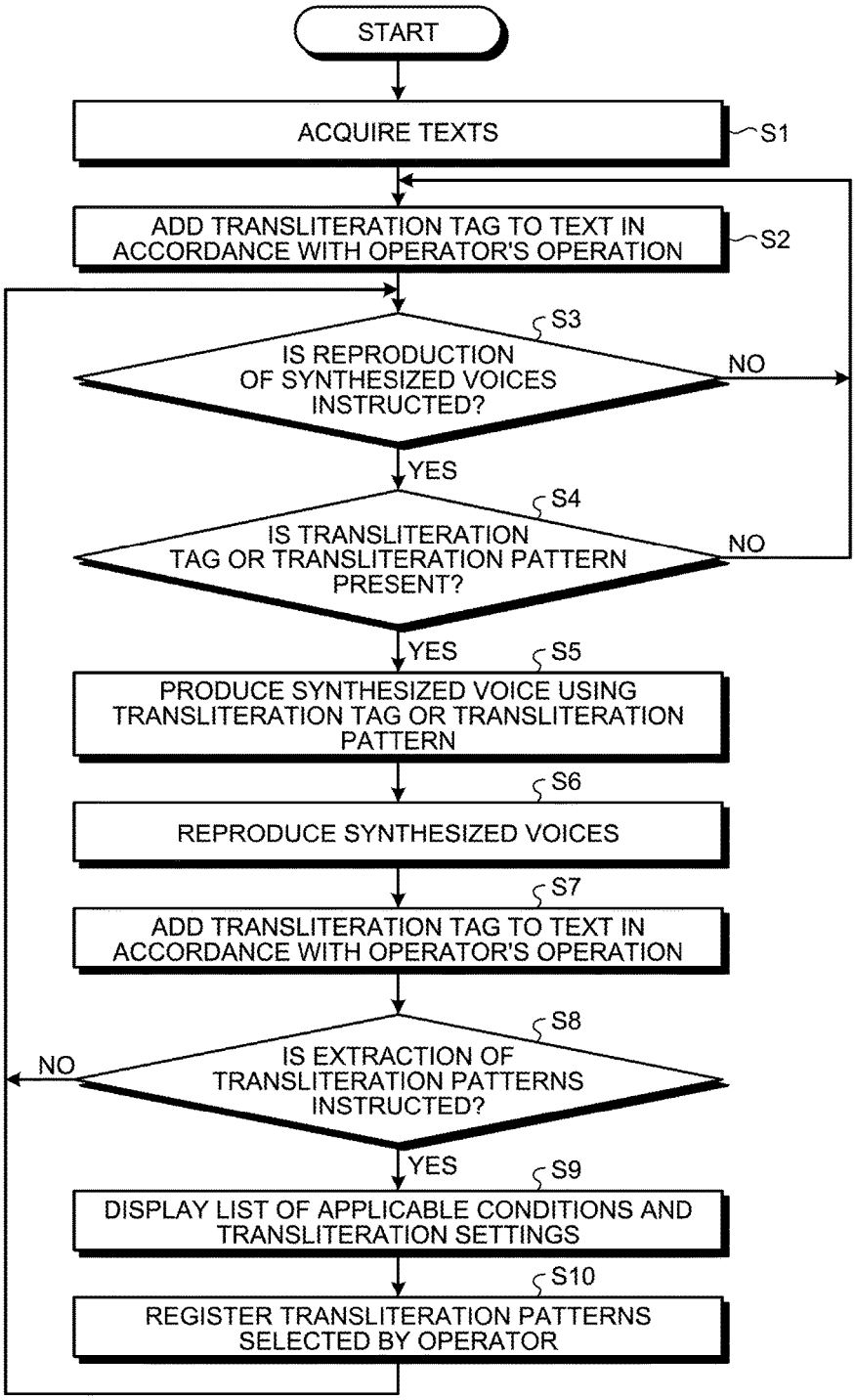
FIG. 3 is a flowchart illustrating a flow of a transliteration support operation performed by the transliteration support device in the first embodiment.

FIG. 3 is a flowchart illustrating a flow of a transliteration support operation performed by the transliteration support device. The transliteration support device is started. The CPU 1 reads the transliteration support program stored in the HDD 5 in response to the operator's operation. The CPU 1 develops the text acquisition unit 11, the transliteration tag addition unit 12, the voice reproduction unit 13, the transliteration pattern extraction unit 14, and the synthesized voice generation unit 15, which correspond to the transliteration support program, in the RAM 3. As a result, the processing in the flowchart of FIG. 3 starts.

At step S1, the text acquisition unit 11 acquires texts designated by the operator. The text is a structured document described in HTML format, for example. HTML is the abbreviation of "hypertext markup language". The text acquisition unit 11 displays the acquired texts on a transliteration work screen used for editing work. The transliteration work screen is described later with reference to FIG. 7. The operator designates desired transliteration setting including, e.g., a speaker, a volume, a pitch, and a temporary stop (pause), for each of the texts. At step S2, the transliteration tag addition unit 12 extends and describes the HTML tag in the text such that the synthesized voice designated by the operator's operation is produced. The tag obtained by extending and describing the structured document tag such as the HTML tag as described above is referred to as a "transliteration tag". The structured document tag in the text is extended and described as described above. As a result, the transliteration tag corresponding to the transliteration setting designated by the operator is added to the text.

At step S3, the voice reproduction unit 13 determines whether the reproduction of the synthesized voices is instructed by the operator via the operation unit 7. Until the reproduction of the synthesized voices is instructed (No at step S3), the transliteration tag addition unit 12 performs the operation of adding the transliteration tag corresponding to the operator's operation on the text at step S2.

If the operator instructs the reproduction of the synthesized voices (Yes at step S3), the voice reproduction unit 13 determines the presence or absence of the transliteration tag indicating the transliteration setting of the text to be reproduced, or of the transliteration pattern, which will be described later, at step S4. If the transliteration tag or transliteration pattern is absent (No at step S4), the transliteration tag addition unit 12 performs the operation of adding the transliteration tag corresponding to the operator's operation on the text, at step S2.

If the transliteration tag or transliteration pattern is present (Yes at step S4), the synthesized voice generation unit 15 produces the synthesized voice corresponding to the text instructed to be reproduced using the transliteration tag or transliteration pattern, at step S5. The voice reproduction unit 13 reproduces the produced synthesized voices, at step S6. As a result, the synthesized voices corresponding to the texts are reproduced by the speaker at the volume, the pitch, and the like, which are designated by the operator.

The operator listens to the reproduced synthesized voices and operates the operation unit 7 so as to designate, via the transliteration work screen, the modification (change) of the speaker, the volume, the pitch, the pause insertion position, and the like in the text determined by the operator necessary to be modified. When the modification work is performed, the transliteration tag addition unit 12 modifies the transliteration setting of the transliteration tag added to the text in accordance with the operator's instruction, at step S7. As a result, the transliteration tag corresponding to the modified transliteration setting is added to the text.

The transliteration support device according to the embodiment extracts the transliteration patterns in each of which a certain applicable condition and a certain transliteration setting are in association with each other, thereby making it possible to uniformly reflect the certain transliteration setting on the respective texts satisfying the certain applicable condition. The operator operates the operation unit 7 so as to extract such transliteration patterns. At step S8, the CPU 1 determines the presence or absence of the operation of designating the extraction of the transliteration patterns.

If the operation of designating the extraction of the transliteration patterns is not detected, the processing returns to step S3. If the operator instructs the reproduction of the synthesized voices (Yes at step S3), the presence or absence of the transliteration tag or the transliteration pattern for the text instructed to be reproduced is determined at step S4. If only the transliteration tag is present in the text instructed to reproduce the synthesized voice, the synthesized voice generation unit 15 produces the synthesized voice in accordance with the transliteration tag at step S5. As a result, the synthesized voice corresponding to the transliteration setting modified at step S7 is produced and reproduced by the voice reproduction unit 13 at step S6.

If the operation of designating the extraction of the transliteration patterns is detected, the processing proceeds to step S9. At step S9, the transliteration pattern extraction unit 14 uses an element of the transliteration tag or a text style as the applicable condition and extracts the transliteration patterns in each of which the applicable condition and the transliteration setting corresponding to the applicable condition are in association with each other, which is described later in detail. The transliteration pattern extraction unit 14 displays a list of the extracted transliteration patterns on a transliteration pattern selection screen illustrated in FIG. 4, for example. In the example illustrated in FIG. 4, the transliteration pattern extraction unit 14 displays the applicable conditions and the transliteration settings of the respective transliteration patterns on the transliteration pattern selection screen. In addition, the transliteration pattern extraction unit 14 displays, on the transliteration pattern selection screen, a check box 18 used for selecting a transliteration pattern desired to be registered and a registration button 19 used for designating the registration of the selected transliteration patterns.

The operator performs the operation of adding a check mark in the check box 18 for the transliteration pattern composed of a desired applicable condition and transliteration setting, and operates the registration button 19. When the registration button 19 is operated, the transliteration pattern extraction unit 14 performs control such that the transliteration patterns having the check boxes 18 to each of which the check mark is added at step S10 are stored (registered) in a pattern dictionary serving as a storage area for the transliteration patterns in the HDD 5.

When the extracted transliteration patterns are stored in the pattern dictionary, the processing returns to step S3. If the operator instructs the reproduction of the synthesized voices (Yes at step S3), the presence or absence of the transliteration tag or the transliteration pattern for the text instructed to be reproduced is determined at step S4. If only the transliteration tag is present in the text instructed to reproduce the synthesized voice, the synthesized voice generation unit 15 produces the synthesized voice in accordance with the transliteration tag. If the transliteration pattern corresponding to the text instructed to reproduce the synthesized voice is present, the synthesized voice generation unit 15 produces the synthesized voice corresponding to the transliteration pattern.

As a result, the text identical with or similar to the text corresponding to the extracted transliteration pattern can be uniformly reproduced in the synthesized voice according to the transliteration setting in the extracted transliteration pattern. This makes it possible to prevent the occurrence of a cumbersome operation such as the operator repeating the same modifications as the modifications on past transliteration settings. As a result, efficient transliteration work can be achieved.

Detailed Operations of Respective Units of Transliteration Support Device

Figures 4, 5:
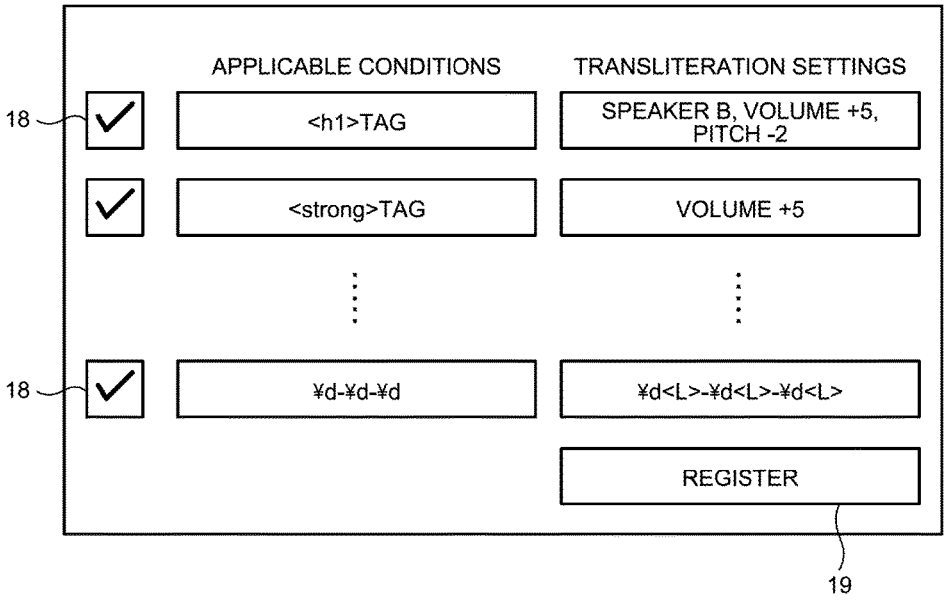
FIG. 4 is a diagram illustrating a transliteration pattern selection screen of the transliteration support device in the first embodiment.
FIG. 5 is a diagram illustrating exemplary texts acquired by the transliteration support device in the first embodiment.

The following describes the operations of the text acquisition unit 11, the transliteration tag addition unit 12, the voice reproduction unit 13, the transliteration pattern extraction unit 14, and the synthesized voice generation unit 15 in detail. FIG. 5 illustrates exemplary texts acquired by the text acquisition unit 11. The transliteration support device according to the embodiment acquires the texts each serving as the structured document described in HTML format, for example. HTML is the abbreviation of "hypertext markup language".

The text may be what is called plain data that includes no tag structures besides the data having the tag structures such as the HTML. The text may be a text compliant with a certain rule such as a rule in which a ruby character string enclosed between brackets is inserted behind a target character string when annotations such as ruby are added.

In the example illustrated in FIG. 5, the texts of titles such as "1. Information", "2. Contact information", "3. Agenda", and "4. Schedule", to each of which HTML tags "<h1>" and "</h1>" are added, are described. In the example illustrated in FIG. 5, an inline element such as "*Important: if you are absent, please contact the following" to which HTML tags "" and "" are added, is described.

In the example illustrated in FIG. 5, block-level elements such as "telephone number is 012-345-**", "cellular phone number is 090-1234-*", and "URL is http://www.*.co.jp", to each of which HTML tags " " and " " are added, are described. In the example illustrated in FIG. 5**, the block-level element such as "2014 (Heisei 26) year 8 month 4 day (Aug. 4, 2014)", to which HTML tags " " and " " are added, is described.

FIG. 6 illustrates exemplary texts to which the transliteration tags are added by the transliteration tag addition unit 12. In the transliteration support device according to the embodiment, the transliteration tag addition unit 12 extends the existing structured document tags such as the HTML tags to the transliteration tags and adds the transliteration tags to the respective texts, for example.

Examples of the type of transliteration tag include synthesized voice parameter information (x-audio-param) used for designating the speaker, the volume, and the pitch of the text and pause information (x-audio-pause) used for designating a temporary stop of the synthesized voice output. Another type of the transliteration tag is reading information (x-audio-ruby="***") indicating the reading of the text. The symbol "*" in the reading information is the reading of the text. Another type of the transliteration tag is non-reading information (x-audio-ruby=" ") used for designating non-output of the synthesized voice corresponding to the text. When the reading information is used, the synthesized voice corresponding to the reading (the symbol of "*") input between double quotations is output. When the non-reading information is used, no reading of the text is input between double quotations. In this case, the synthesized voice corresponding to the designated text is not output. Another type of the transliteration tag is accent information (strong) used for designating a volume of the synthesized voice of the text.

It is assumed that the operator designates the generation of the synthesized voice according to a transliteration setting "the speaker is Mr. B, the volume is +10, and the pitch is +3" for the text of the title "1. Information" illustrated in FIG. 5. In this case, the transliteration tag addition unit 12 extends the HTML tags "<h1>" and "</h1>" for the text of the title "1. Information" and describes it as "<h1 x-audio-param="B,+10,+3">1. Information</h1>" as illustrated in FIG. 6, for example. As a result, the transliteration tag of the synthesized voice parameter information (x-audio-param) is added to the text of the title "1. Information".

It is assumed that the operator designates the reading "yu-aru-eru" to the text "URL" illustrated in FIG. 5. In this case, the transliteration tag addition unit 12 extends the HTML tags for "URL" and describes it as "URL" as illustrated in FIG. 6, for example. As a result, the transliteration tag of the reading information (x-audio-ruby="***") that outputs the synthesized voice "yu-aru-eru" is added to the text "URL".

It is assumed that the operator designates the insertion of a pause that temporarily stops the output of the synthesized voice behind "2" and behind "5" in the text of the telephone number "012-345-**" illustrated in FIG. 5. In this case, the transliteration tag addition unit 12 extends the HTML tags for the telephone number "012-345-" and describes it as "012<span x-audio-pause>-345<span x-audio-pause>-" as illustrated in FIG. 6**, for example. As a result, the transliteration tag of the pause information that temporarily stops the output of the synthesized voice is added between "2" and "3", and between "5" and "*" in the telephone number "012-345-****".

It is assumed that the operator designates the non-output of the synthesized voice of the date text "(Heisei 26)" illustrated in FIG. 5. In this case, the transliteration tag addition unit 12 extends the HTML tags for "(Heisei 26)" and describes it as "(Heisei 26)" as illustrated in FIG. 6, for example. As a result, the transliteration tag of the non-reading information (x-audio-ruby=" ") that causes the synthesized voice corresponding to the text "(Heisei 26)" not to be output is added.

Figure 7:
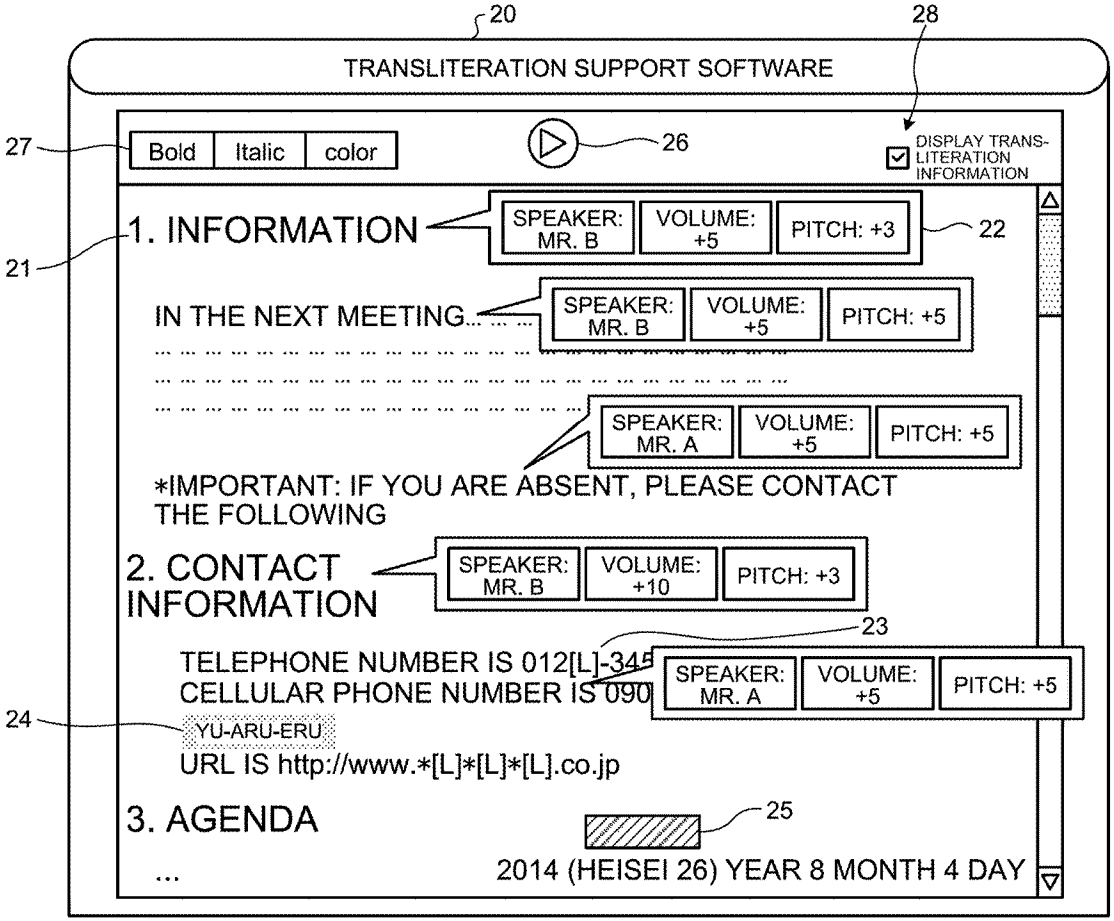
FIG. 7 is a diagram illustrating an exemplary transliteration work screen used for transliteration setting displayed by the transliteration support device in the first embodiment.

FIG. 7 illustrates an exemplary transliteration work screen for the texts to which the transliteration tags are added. The CPU 1 displays the transliteration work screen on the display unit 6 in accordance with the transliteration support program stored in the HDD 5. In the example illustrated in FIG. 7, the CPU 1 displays, on the transliteration work screen, a name 20 of software, e.g., "transliteration support software", attached to the transliteration support program. In addition, the CPU 1 displays, on the transliteration work screen, texts 21 each of which is the structured document described in HTML format, for example, such as "1. Information" and "2. Contact information".

Furthermore, the CPU 1 displays, on the transliteration work screen, the transliteration tags added to the texts 21, such as the synthesized voice parameter information, the pause information, the reading information, and non-reading information, and an editing form. Specifically, in the example illustrated in FIG. 7, the transliteration tags such as "speaker: Mr. B", "volume: +10", and "pitch: +3" are synthesized voice parameter information 22. The transliteration tag displayed as "L" is pause information 23 set to the text. The transliteration tag "yu-aru-eru" displayed as the superscript of URL is reading information 24. The belt-like mark displayed above the date text "(Heisei 26)" in the bottom line in FIG. 7 is non-reading information 25 indicating that the synthesized voice of the text "(Heisei 26)" is caused not to be output (not to be read).

The CPU 1 displays, on the transliteration work screen, an operation button 26 used for reproducing the synthesized voices corresponding to the texts or designating a temporary stop of the reproduction. The CPU 1 displays, on the transliteration work screen, a character decoration form 27 used for performing character decorations such as a bold character (Bold), a slanted character (Italic) and a character color (color) on the displayed texts.

The synthesized voice parameter information 22 can be designated or modified when the operator operates a selection box or a slide bar for the synthesized voice parameter information 22. The transliteration tag addition unit 12 adds, to the text, the synthesized voice parameter information 22 corresponding to the operator's operation performed on the selection box or the slide bar. The operator designates any position in the text by key operation performed on the operation unit 7 to designate the insertion of the pause information 23. The transliteration tag addition unit 12 inserts (adds) the pause information 23 to the position designated by the operator in the text. When the operator inputs the reading of the text selected by the key operation performed on the operation unit 7, the transliteration tag addition unit 12 adds the reading information 24 corresponding to the input reading to the selected text.

Figure 8:
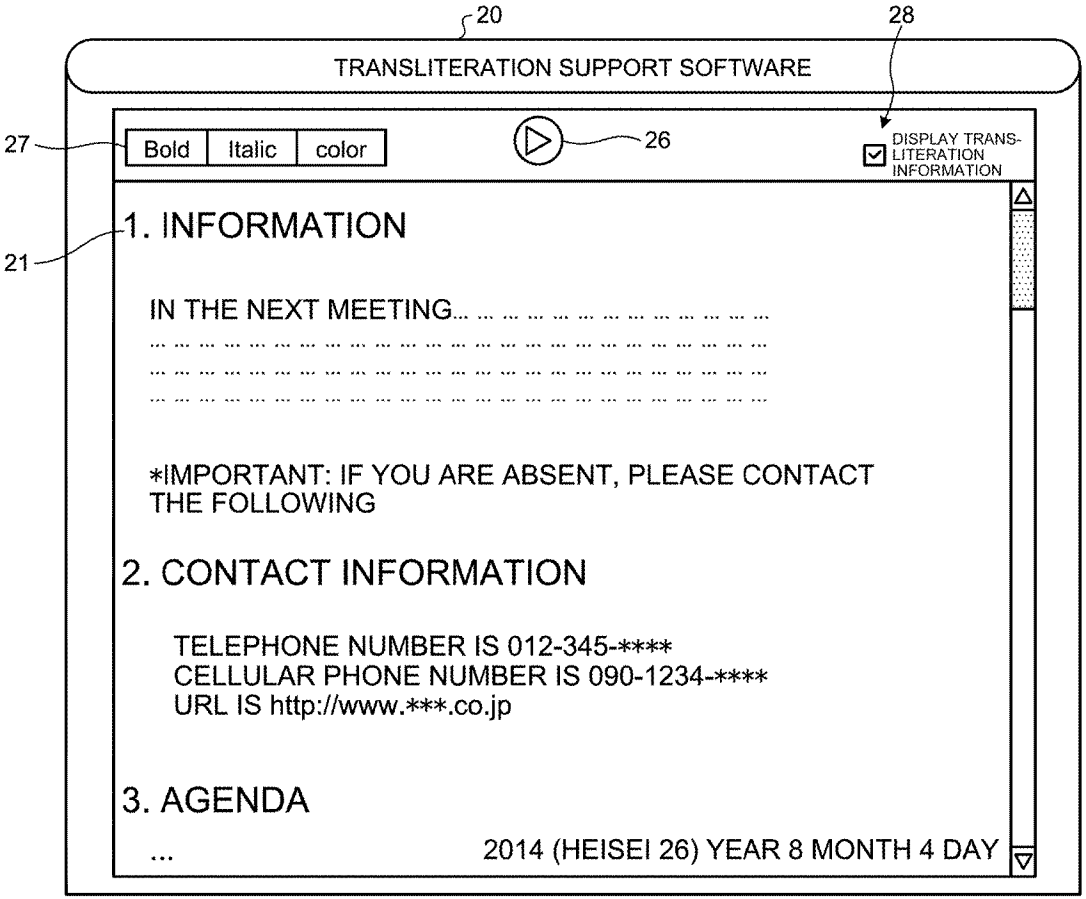
FIG. 8 is a diagram illustrating the transliteration work screen in which the transliteration tags are not displayed.

The operator can select display or non-display of such transliteration tags. The CPU 1 displays, on the transliteration work screen, a check box 28 used for selecting display or non-display of the transliteration tags. When the operator wants to display the transliteration tags, the operator performs operation of adding a check to the check box 28 as the example illustrated in FIG. 7. When the operation of adding a check to the check box 28 is performed, the CPU 1 performs control such that the transliteration tags added to the respective texts are displayed as the example illustrated in FIG. 7. In contrast, until the operation of adding a check to the check box 28 is performed (in a time period where no check is added), the CPU 1 causes the transliteration tags added to the respective texts not to be displayed as the example illustrated in FIG. 8.

Operation of Transliteration Pattern Extraction Unit

The transliteration pattern extraction unit 14 sets the element of the transliteration tag or the text format as the applicable condition, extracts the transliteration patterns in each of which the applicable condition and the transliteration setting corresponding to the applicable condition are in association with each other, and performs control such that the transliteration patterns are stored (registered) in the pattern dictionary in the HDD 5.

For example, when the transliteration pattern of the pause information is registered, the transliteration pattern extraction unit 14 detects the respective texts to each of which the transliteration tag of the pause information (<span x-audio-pause>) is added by the transliteration tag addition unit 12 as described above. The transliteration pattern extraction unit 14, then, determines whether character strings satisfying the following conditions are present in the detected texts using template matching. A regular expression can be used in the template matching, for example.

The transliteration pattern extraction unit 14 determines whether a telephone number style character string composed of only numbers and symbols (hyphens or brackets) is present in the detected texts. The transliteration pattern extraction unit 14 determines whether a URL style character string that starts with "http://" and is composed of only alphanumeric characters and symbols (dots) is present in the detected texts. The transliteration pattern extraction unit 14 determines whether a date style character string composed of only numerical values and character strings of "year", "month", and "day" is present in the detected texts.

When determining that the character strings satisfying such conditions are present, the transliteration pattern extraction unit 14 registers the "transliteration patterns" in each of which the "applicable condition" corresponding to each of the character strings and the "transliteration setting" are in association with each other.

Specifically, when the detected text is the telephone number style text, the transliteration pattern extraction unit 14 sets the telephone number style as the applicable condition as illustrated in FIG. 9. In this case, the transliteration pattern extraction unit 14 sets the transliteration setting "the tag of the pause information (pause tag) is added before hyphen (-) and the tag of the reading information (reading tag) of "no", which is the reading of hyphen, is added". The transliteration pattern extraction unit 14 registers, in the pattern dictionary, the transliteration pattern in which the applicable condition set to be the telephone number style and the transliteration setting described above are in association with each other.

As a result, when the text is the telephone number style text, the synthesized voice is produced that corresponds to the transliteration tag "012<ruby>-<rt>no</rt><L/></ruby>345<ruby>-<rt>no</rt><L/></ruby>****" by the transliteration pattern, for example.

When the detected text is the URL style text, the transliteration pattern extraction unit 14 sets the URL style as the applicable condition as illustrated in FIG. 9. In this case, the transliteration pattern extraction unit 14 sets the transliteration setting "the pause tag is added between alphanumeric characters between "http://" and ".co.jp"". The transliteration pattern extraction unit 14 registers, in the pattern dictionary, the transliteration pattern in which the applicable condition set to be the URL style and the transliteration setting described above are in association with each other.

As a result, when the text is the URL style text, the synthesized voice is produced that corresponds to the transliteration tag "http://.<L/>*<L/>*<L/>*.co.jp" by the transliteration pattern, for example.

When the detected text has the date style of "numerical value (Heisei (numerical value) year" such as "2014 (Heisei 26) year (year 2014 in English)", the transliteration pattern extraction unit 14 sets the date style as the applicable condition as illustrated in FIG. 9. In this case, the transliteration pattern extraction unit 14 sets the transliteration setting "the reading tag whose reading is a null character string (is not read) is added to "(Heisei (numerical value))"". The transliteration pattern extraction unit 14 registers, in the pattern dictionary, the transliteration pattern in which the applicable condition set to be the date style and the transliteration setting described above are in association with each other.

As a result, when the text is the date style text, the synthesized voice is produced that corresponds to the transliteration tag "2014<ruby>(Heisei 26)<rt></rt></ruby>" by the transliteration pattern, for example.

When the detected text has the date style without "(Heisei (numeric value))" such as "2014 year 8 month 4 day (Aug. 4, 2014 in English)", the transliteration pattern extraction unit 14 sets the date style as the applicable condition. In this case, the transliteration pattern extraction unit 14 sets the transliteration setting "the pause tag is added before special characters for "year", "month", and "day"". The transliteration pattern extraction unit 14 registers, in the pattern dictionary, the transliteration pattern in which the applicable condition set to be the date style and the transliteration setting described above are in association with each other.

As a result, when the text has the date style without description of "(Heisei (numerical value))", the synthesized voice is produced that corresponds to the transliteration tag "2014<ruby>(Heisei 26)<rt></rt></ruby>" by the transliteration pattern, for example.

The transliteration pattern extraction unit 14 may register the transliteration pattern in the following manner. When the telephone number type character string, the URL type character string, and the date type character string are detected, the pause positions in the detected character strings are acquired. It is, then, determined whether the interval between the pause positions is equal to a certain number of characters. When the interval is equal to the certain number of characters, the transliteration pattern extraction unit 14 registers, in the pattern dictionary, the transliteration pattern in which the applicable condition set to be the telephone number style or the like and the transliteration setting "the pauses are inserted in an interval of the constant number of characters" are in association with each other.

Alternatively, the transliteration pattern extraction unit 14 acquires the respective characters before and after the pause with respect to all of the pause positions. When the acquired characters are symbol characters and the special characters for "year", "month", and "day", the transliteration pattern extraction unit 14 detects the numbers of appearances of the respective characters. When the character having the number of appearances equal to or larger than a certain number is detected, the transliteration pattern extraction unit 14 registers, in the pattern dictionary, the transliteration pattern in which the applicable condition set to be the telephone number style or the like and the transliteration setting "the pause is inserted before a symbol character or the special character" are in association with each other.

Besides the examples described above, the transliteration pattern extraction unit 14 may perform morpheme analysis on the text to classify word classes, and thereafter may register a pattern of a word class series and a pause position as the transliteration pattern. Alternatively, the transliteration pattern extraction unit 14 may register a pattern of punctuation and a pause position as the transliteration pattern in the text.

When the transliteration pattern of the synthesized voice parameter information is registered, the transliteration pattern extraction unit 14 acquires, from all of the texts, the transliteration tags of the synthesized voice parameter information added by the transliteration tag addition unit 12. Specifically, the transliteration pattern extraction unit 14 acquires, from all of the texts, the transliteration tags including the synthesized voice parameter information "x-audio-param". The transliteration pattern extraction unit 14 detects the elements of the respective acquired transliteration tags. The transliteration pattern extraction unit 14 detects the numbers of combination times of the elements and the synthesized voice parameter information. When the element having the number of combination times equal to or larger than a certain number is detected, the transliteration pattern extraction unit 14 registers, in the pattern dictionary, the transliteration pattern in which the element name set as the applicable condition and the value of the synthesized voice parameter information are in association with each other.

For example, when the name of the detected element having the number of combination times equal to or larger than a certain number is h1, the transliteration pattern extraction unit 14 sets the element h1 as the applicable condition as illustrated in FIG. 9. The transliteration pattern extraction unit 14 sets, as the transliteration setting, the detected synthesized voice parameter information having the number of combination times equal to or larger than a certain number, e.g., the detected synthesized voice parameter information "the speaker is Mr. B, the volume is +5, and the pitch is −2". The transliteration pattern extraction unit 14 registers, in the pattern dictionary, the transliteration pattern in which the applicable condition and the synthesized voice parameter information are in association with each other.

When the detected element having the number of combination times equal to or larger than a certain number is the element strong, the transliteration pattern extraction unit 14 sets the element strong as the applicable condition as illustrated in FIG. 9. The transliteration pattern extraction unit 14 sets, as the transliteration setting, the detected synthesized voice parameter information having the number of combination times equal to or larger than a certain number, e.g., the detected synthesized voice parameter information "the volume is +5". The transliteration pattern extraction unit 14 sets, as the transliteration setting, the synthesized voice parameter information in which only the volume is changed to "+5" without changing the speaker and the pitch out of the speaker, the volume, and the pitch of the synthesized voice parameter information. The transliteration pattern extraction unit 14 registers, in the pattern dictionary, the transliteration pattern in which the applicable condition and the synthesized voice parameter information are in association with each other.

When the transliteration pattern of the reading information is registered, the transliteration pattern extraction unit 14 acquires, from all of the texts, the transliteration tags of the reading information added by the transliteration tag addition unit 12. Specifically, the transliteration pattern extraction unit 14 detects, from all of the texts, the transliteration tags including the synthesized voice parameter information "x-audio-ruby". The transliteration pattern extraction unit 14 detects the elements of the respective acquired transliteration tags. The transliteration pattern extraction unit 14 detects the numbers of combination times of the elements and the reading information. When the element having the number of combination times equal to or larger than a certain number is detected, the transliteration pattern extraction unit 14 registers, in the pattern dictionary, the transliteration pattern in which the applicable condition set to be the element name and the reading information are in association with each other as the transliteration setting.

For example, when the name of the detected element having the number of combination times equal to or larger than a certain number is span, the transliteration pattern extraction unit 14 sets the element span as the applicable condition. The transliteration pattern extraction unit 14 sets the detected reading information having the number of combination times equal to or larger than a certain number as the transliteration setting. The transliteration pattern extraction unit 14 registers, in the pattern dictionary, the transliteration pattern in which the applicable condition and the reading information are in association with each other. Alternatively, the text including the element span may be acquired, the text may be subjected to the morpheme analysis to classify word classes, and thereafter, the word class series, notations, and the reading information may be registered as the transliteration pattern.

When the reading of the acquired transliteration tag is a null character string (i.e., non-reading information: x-audio-ruby=" "), the transliteration pattern extraction unit 14 registers, as the transliteration pattern in the pattern dictionary, a non-reading pattern extracted from the acquired text using a regular expression, for example.

The transliteration pattern extraction unit 14 detects the text having the date style character string composed of only numbers, symbols, and the special characters for "year", "month", "day", and "Heisei". As a result, a character string "2014 (Heisei 26) year" is detected, for example. When the transliteration tag of the non-reading information is included in the detected text, the transliteration pattern extraction unit 14 registers, in the pattern dictionary, the transliteration pattern in which the applicable condition set to be the date style characteristic string and the transliteration setting "the character string in brackets is not read" are in association with each other.

Operation of Synthesized Voice Generation Unit

When receiving a request for producing the synthesized voice from the voice reproduction unit 13, the synthesized voice generation unit 15 acquires the texts in a block serving as the target of voice synthesis. The synthesized voice generation unit 15 converts the texts into a language having a format recognizable by a voice synthesis engine using the transliteration tags included in the acquired texts in the block and the transliteration patterns extracted by the transliteration pattern extraction unit 14. The synthesized voice generation unit 15 converts the text into a language in an SSML format, for example. SSML is the abbreviation of "speech synthesis markup language". The synthesized voice generation unit 15, then, supplies the language after the conversion to the voice synthesis engine to produce the synthesized voices corresponding to the texts, and supplies the produced synthesized voices to the voice reproduction unit 13.

Operation of Voice Reproduction Unit

When the operator operates the operation button 26 illustrated in FIG. 7 to instruct the voice reproduction, the voice reproduction unit 13 requests the synthesized voice generation unit 15 to produce the synthesized voices. The voice reproduction unit 13 acquires the synthesized voices produced by the synthesized voice generation unit 15 and reproduces the synthesized voices.

Advantageous Effects of First Embodiment

It is obvious from the above description that the transliteration support device in the first embodiment adds the transliteration tags each serving as the transliteration setting information such as the reading, the accent, and the pause to the input texts. The transliteration support device extracts the transliteration patterns in each of which the frequent appearance transliteration setting out of the transliteration settings indicated by the transliteration tags added to the texts and the applicable condition of the frequent appearance transliteration setting are in association with each other. Alternatively, the transliteration support device extracts the transliteration patterns in each of which the text style serving as the applicable condition and the transliteration setting corresponding to the text style serving as the applicable condition are in association with each other. The transliteration support device produces the synthesized voices corresponding to the transliteration tags added to the texts or the transliteration settings indicated by the extracted transliteration patterns.

As a result, the synthesized voice of each text (the text identical with or similar to the text from which the transliteration pattern is extracted) corresponding to the applicable condition can be uniformly set in the synthesized voice according to the transliteration setting in the extracted transliteration pattern. This makes it possible to prevent the inconvenience that the operator repeats the modification of the transliteration setting on the same or the similar text. As a result, an efficient transliteration operation can be achieved.

Second Embodiment

The following describes a transliteration support device in a second embodiment. The transliteration support device in the second embodiment stores therein history information (transliteration history data) about the operator's transliteration work. The transliteration support device calculates a reliability of the transliteration (transliteration reliability) from the transliteration history data. The transliteration support device determines the transliteration pattern used for producing the synthesized voice in accordance with the calculated transliteration reliability. The following describes only such differences from the first embodiment, and the description duplicated with that of the first embodiment is omitted.

Structure of Second Embodiment

Figure 10:
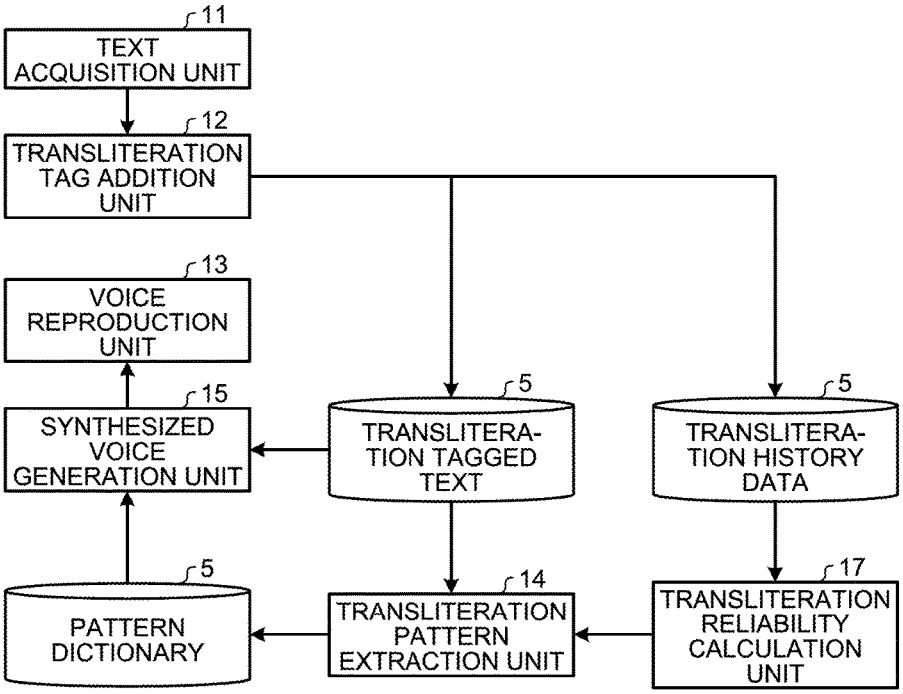
FIG. 10 is a hardware structural diagram of a transliteration support device in a second embodiment.

FIG. 10 illustrates a block diagram of the transliteration support device in the second embodiment. In FIG. 10, the block indicating the same operation as the block illustrated in FIG. 2 has the same numeral. As illustrated in FIG. 10, the transliteration support device in the second embodiment stores the history information (transliteration history data) produced by the transliteration tag addition unit 12 in accordance with the operator's transliteration work in the storage unit such as the HDD 5. The transliteration support device in the second embodiment includes a transliteration reliability calculation unit 17 that calculates the transliteration reliability using the transliteration history data stored in the HDD 5.

Operation in Second Embodiment

The transliteration history data includes a transliteration tag identifier that uniquely identifies the transliteration tag added by the transliteration tag addition unit 12, the transliteration setting of the transliteration tag, and an update time of the transliteration tag. When updating the transliteration tag in accordance with the operator's instruction, the transliteration tag addition unit 12 updates the transliteration tag update time of the transliteration tag identifier in the transliteration history data stored in the HDD 5.

The transliteration reliability calculation unit 17 calculates the transliteration reliability from the transliteration history data. For example, when the number of updates of the transliteration tag is large even in a short time period, this case means that the operator repeats uncertain transliteration setting. In this case, the transliteration reliability calculation unit 17 calculates a low transliteration reliability for the transliteration reliability of the transliteration tag.

Specifically, the transliteration reliability calculation unit 17 calculates the transliteration reliability of the transliteration tag using expression 1. In expression 1, "α" and "β" each represent a constant.

Transliteration reliability of transliteration tag $i$=(current transliteration reliability of transliteration tag $i$)−α×(the number of updates of tag $i$)/(difference between current time and last update time of tag $i$) (Expression 1)

The transliteration pattern extraction unit 14 calculates the reliability of each transliteration pattern by performing the calculation in expression 2 using the transliteration reliabilities calculated by the transliteration reliability calculation unit 17, for example.

Reliability=(sum of transliteration reliabilities of target transliteration tags)/(the number of target transliteration tags) (Expression 2)

Figure 11:
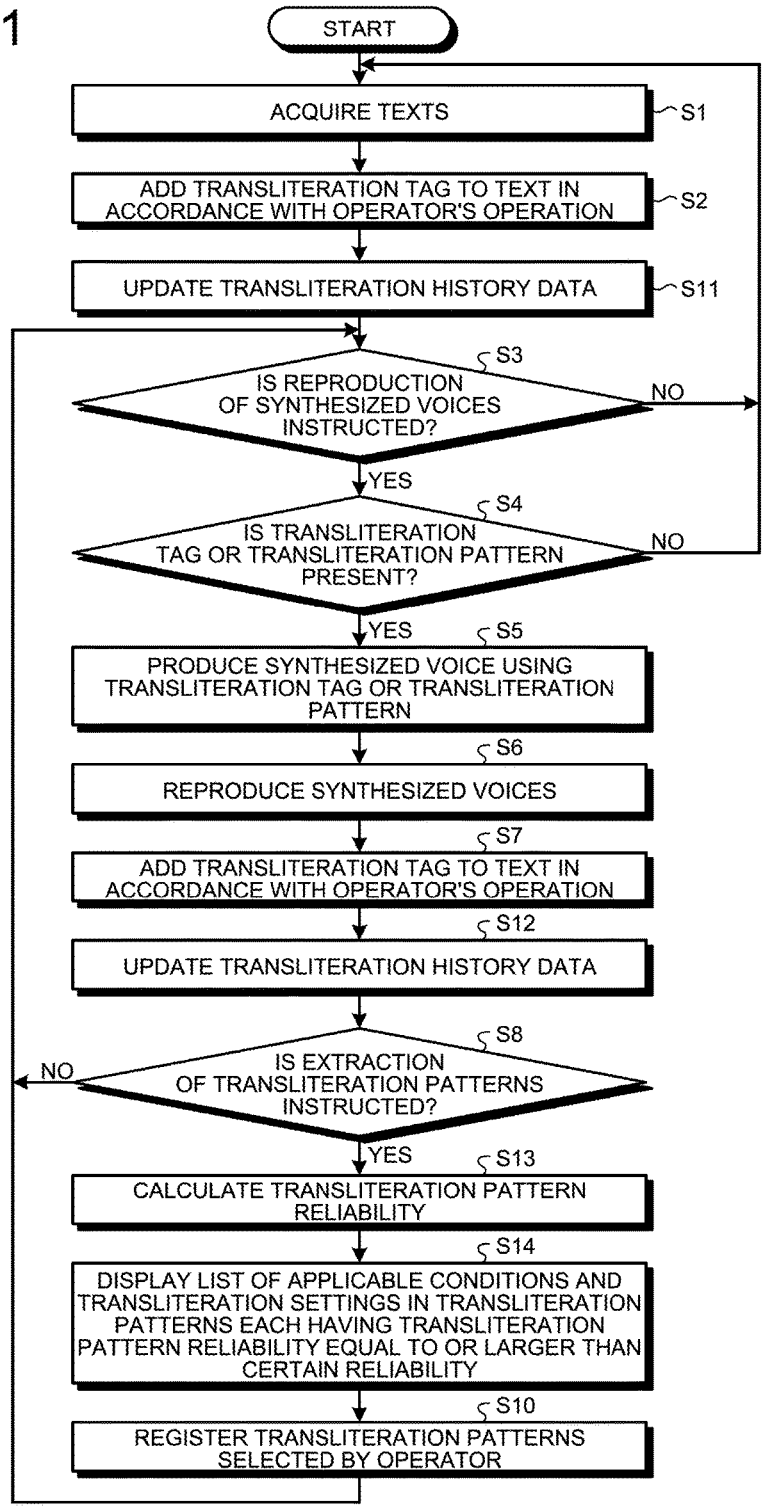
FIG. 11 is a flowchart illustrating a flow of the transliteration support operation performed by the transliteration support device in the second embodiment.

The transliteration pattern extraction unit 14 registers, in the pattern dictionary, only the transliteration patterns each having the reliability equal to or larger than a certain value, the reliability being calculated by expression 2. The flowchart in FIG. 11 illustrates the flow of such processing. In the flowchart illustrated in FIG. 11, the step at which the same operation is performed as that in the first embodiment described with reference to FIG. 3 has the same step number. The flowchart illustrated in FIG. 11 differs from that in the flowchart illustrated in FIG. 3 in that processing from step S11 to step S14 is added.

In the transliteration support device in the second embodiment, when the operator sets the transliteration setting at step S2 and modifies the transliteration setting at step S7, the transliteration tag addition unit 12 updates the "transliteration tag update time" of the transliteration tag in the transliteration work history data stored in the HDD 5 at step S11 and step S12.

When the operator's instruction to extract the transliteration patterns is detected at step S8, the transliteration reliability calculation unit 17 calculates the transliteration reliabilities of respective transliteration tags stored in the HDD 5 using expression 1 at step S13.

At step S14, the transliteration pattern extraction unit 14 calculates the reliabilities of respective transliteration patterns by performing the calculation in expression 2 using the transliteration reliabilities calculated by the transliteration reliability calculation unit 17. The transliteration pattern extraction unit 14 extracts the transliteration patterns each having the reliability equal to or larger than a certain value, and displays a list of the applicable conditions and the transliteration settings on the display unit 6 in the manner as described with reference to FIG. 4. At step S10, the transliteration pattern extraction unit 14 registers, in the pattern dictionary, the transliteration patterns selected by the operator.

The following describes the update operation of the transliteration history data and the calculation operation of the transliteration reliability in more detail using the texts illustrated in FIG. 5 as an example. The update time of the transliteration tag is a time that has elapsed from the start of the transliteration work (a time that has elapsed from a time at which the transliteration work screen illustrated in FIG. 7 starts to be displayed). An initial value of the transliteration reliability is 100. The constant α in expression 1 is 10.

It is assumed that the operator designates that the speaker is "Mr. B", the volume is "+10", and the pitch is "+3" for the text of the title "1. Information" illustrated in FIG. 4 five seconds after the start of the work. In this case, the transliteration tag addition unit 12 extends the HTML tags for the text "1. Information" and describes it as "<h1 id="1" x-audio-param="B,+10,+3">1. Information</h1>", which is the transliteration tag having the transliteration setting and the transliteration tag identifier.

As illustrated in FIG. 12, the transliteration tag addition unit 12 stores "1", which is the transliteration tag identifier, the transliteration setting "x-audio-param="B,+10,+3"", and transliteration tag update time information "00:00:05" in a storage area for the transliteration history data in the HDD 5 as the transliteration history data. The transliteration reliability of the transliteration tag having the transliteration tag identifier "1" at the transliteration tag update time "00:00:05" is "100".

It is assumed that the operator updates the pitch to "+1" after 15 seconds. In this case, the transliteration tag addition unit 12 changes the HTML tags for the text "1. Information" and describes it as "<h1 id="1" x-audio-param="B,+10,+1">1. Information</h1>". As illustrated in FIG. 12, the transliteration tag addition unit 12 stores the transliteration setting "x-audio-param="B,+10,+1"" of the transliteration tag having the transliteration tag identifier "1", and the transliteration tag update time "00:00:15" in the HDD 5 as the transliteration history data. The transliteration reliability of the transliteration tag having the transliteration tag identifier "1" at the transliteration tag update time "00:00:15" is "100−10×2/10=98".

It is assumed that the operator updates the pitch to "+3" after 30 seconds. In this case, the transliteration tag addition unit 12 changes the HTML tags for the text "1. Information" and describes it as "<h1 id="1" x-audio-param="B,+10,+3">1. Information</h1>". As illustrated in FIG. 12, the transliteration tag addition unit 12 stores the transliteration setting "x-audio-param="B,+10,+3"" of the transliteration tag having the transliteration tag identifier "1", and the transliteration tag update time "00:00:30" in the HDD 5 as the transliteration history data. The transliteration reliability of the transliteration tag having the transliteration tag identifier "1" at the transliteration tag update time "00:00:30" is "98−10×3/15=96".

FIG. 12 illustrates the examples of the transliteration history data of the text "2. Contact information" and the text "3. Agenda". The text "2. Contact information" and the text "3. Agenda" are illustrated in FIG. 5. The transliteration setting and the transliteration tag update time information of the transliteration tag having transliteration tag identifier "2" illustrated in FIG. 12 are the transliteration history data of the text "2. Contact information" illustrated in FIG. 5. The transliteration setting and the transliteration tag update time information of the transliteration tag having transliteration tag identifier "3" illustrated in FIG. 12 are the transliteration history data of the text "3. Agenda" illustrated in FIG. 5.

The transliteration history data of the text "2. Contact information" is an example of the transliteration setting "the speaker is "Mr. B", the volume is "+10", and the pitch is "+3"" set by the operator at "00:00:40". The transliteration history data of the text "2. Contact information" is an example where the pitch is updated to "+2" at "00:00:45" and the pitch is updated to "+1" at "00:00:50".

The transliteration reliability of the transliteration tag having transliteration tag identifier "2" is "100" at "00:00:40", "100−10×2/5=96" at "00:00:45", and "96−10×3/5=90" at "00:00:50".

The transliteration history data of the text "3. Agenda" is an example of the transliteration setting "the speaker is "Mr. B", the volume is "+10", and the pitch is "+1"" set by the operator at "00:01:00". The transliteration history data of the text "3. Agenda" is an example where the pitch is updated to "+3" at "00:01:10". The transliteration reliability of the transliteration tag having transliteration tag identifier "3" is "100" at "00:01:00", and "100×10×2/10=98" at "00:01:10".

The transliteration pattern extraction unit 14 extracts the transliteration patterns each having the thus calculated reliability equal to or larger than a certain value, and displays a list of the applicable conditions and the transliteration settings on the display unit 6 in the manner as described with reference to FIG. 4. The transliteration pattern extraction unit 14 registers, in the pattern dictionary, the transliteration patterns selected by the operator.

At "00:01:10", which is the update time of the transliteration tag having transliteration tag identifier "3", the following three transliteration patterns are present as the candidates of the transliteration patterns that the transliteration pattern extraction unit 14 extracts. The transliteration tag is present that has transliteration tag identifier "1" and the transliteration setting "the speaker is Mr. B, the volume is +10, and the pitch is +3". The transliteration tag is present that has transliteration tag identifier "3" and the transliteration setting "the speaker is Mr. B, the volume is +10, and the pitch is +3". The transliteration tag is present that has transliteration tag identifier "2" and the transliteration setting "the speaker is Mr. B, the volume is +10, and the pitch is +1".

In this case, the transliteration tag having transliteration tag identifier "1" and the transliteration tag having transliteration tag identifier "3" each have the transliteration pattern "the speaker is Mr. B, the volume is +10, and the pitch is +3". The transliteration pattern extraction unit 14 detects the average of the reliabilities at the respective final update times of the transliteration tag having transliteration tag identifier "1" and the transliteration tag having transliteration tag identifier "3". In the example, the reliability of the transliteration pattern of the transliteration tag having transliteration tag identifier "1" is "96". The reliability of the transliteration pattern of the transliteration tag having transliteration tag identifier "3" is "98". The transliteration pattern extraction unit 14 calculates the reliability of the transliteration pattern "the speaker is Mr. B, the volume is +10, and the pitch is +3" as "(96+98)/2=97".

The transliteration pattern extraction unit 14 compares the calculated average "97" with the reliability "90" of the transliteration pattern of the transliteration tag having transliteration tag identifier "2". The transliteration pattern of the transliteration tag having transliteration tag identifier "2" is the transliteration pattern of the other transliteration tag, which is solely present in this example. In this case, the transliteration pattern "the speaker is Mr. B, the volume is +10, and the pitch is +3" has a higher reliability. The transliteration pattern extraction unit 14, thus, extracts the transliteration pattern "the speaker is Mr. B, the volume is +10, and the pitch is +3" and registers the extracted transliteration pattern in the pattern dictionary.

When a plurality of same transliteration patterns are present, the transliteration pattern extraction unit 14 calculates the average of the reliabilities thereof at the respective final update times. The transliteration pattern extraction unit 14 compares the calculated average of the reliabilities with the other reliability solely present, extracts the transliteration pattern having a higher reliability, and registers the extracted transliteration pattern in the pattern dictionary. As a result, only the transliteration pattern having a high reliability is usable.

Advantageous Effects of Second Embodiment

The transliteration support device in the second embodiment can register and use only the transliteration pattern having a high reliability. The transliteration support device in the second embodiment, thus, can achieve highly accurate transliteration support and also obtain the same advantageous effects as the first embodiment.

Third Embodiment

The following describes a transliteration support device in a third embodiment. It is preferable for the operator who performs transliteration to set the transliteration setting of the text to be the transliteration setting preferred by more people. The transliteration support device in the third embodiment enables third parties (participants) to listen to voices of candidate transliteration settings using an external service such as a crowdsourcing service. The transliteration support device in the third embodiment selects the transliteration setting mostly supported by the participants. As a result, the transliteration setting of the text can be set to be the transliteration setting preferred by more people. The following describes only such differences from the embodiments described above, and the description duplicated with that of each embodiment is omitted. In the following description, the external service can receive a single file (e.g., a compressed file such as a zip file) including XML data and voice data via a Web API, for example.

Structure of Third Embodiment

Figure 13:
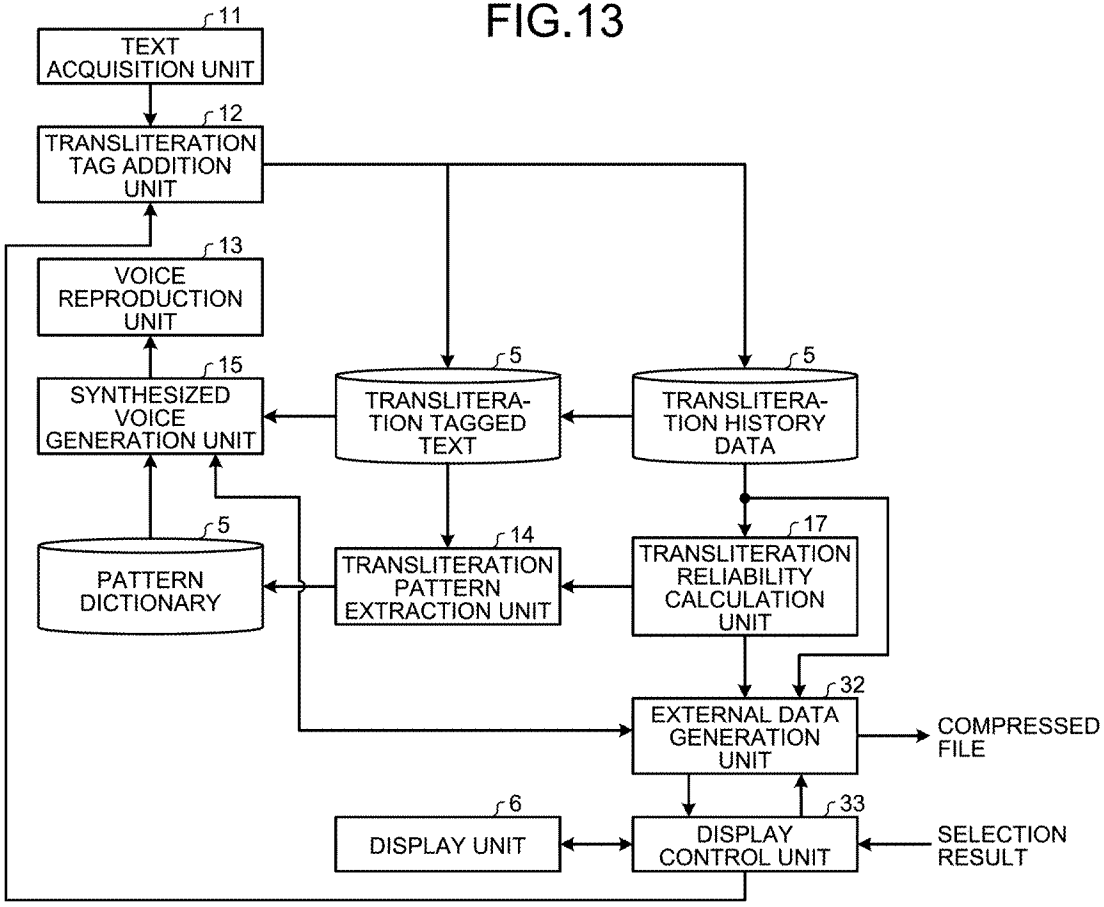
FIG. 13 is a hardware structural diagram of a transliteration support device in a third embodiment.

FIG. 13 illustrates a block diagram of the transliteration support device in the third embodiment. In FIG. 13, the block indicating the same operation as the block illustrated in FIG. 10 has the same numeral. As illustrated in FIG. 13, the transliteration support device in the third embodiment includes an external data generation unit 32 that produces external data to be transmitted to the external service from the transliteration history data stored in the HDD 5 and the transliteration reliabilities calculated as described above. The transliteration support device in the third embodiment includes a display control unit 33 that performs control such that an external data selection screen and an external data generation screen, which are described later, are displayed on the display unit 6.

Operation in Third Embodiment

The transliteration support device in the third embodiment transmits the external data produced by the following flow to the external service performed by a server on a network (crowdsourcing). The operator operates the operation unit 7 to instruct to display the external data selection screen. The display control unit 33 reads, from the HDD 5, the respective transliteration tags currently set to the texts and the transliteration reliabilities of the transliteration tags, produces the external data selection screen, and displays the external data selection screen on the display unit 6.

Figure 14:
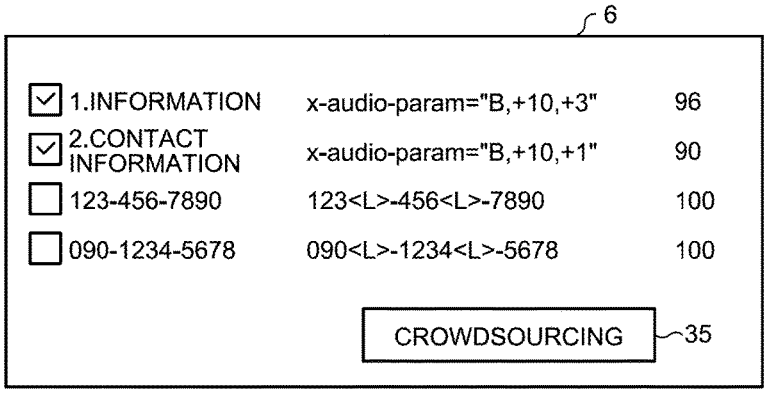
FIG. 14 is a diagram illustrating an exemplary external data selection screen displayed by the transliteration support device in the third embodiment.

FIG. 14 is an exemplary display of the external data selection screen. As illustrated in FIG. 14, the display control unit 33 reads, from the HDD 5, the texts such as the text "1. Information" and the text "2. Contact information", which are described with reference to FIG. 5, and displays them on the external data selection screen. The display control unit 33 reads, from the HDD 5, the transliteration tags added to the respective texts, such as "x-audio-param="B,+10,+3"", and displays them on the external data selection screen. The display control unit 33 reads, from the HDD 5, the transliteration reliabilities calculated using the update histories of the respective transliteration tags, such as "96" and "90", and displays them on the external data selection screen. The display control unit 33 displays a generation button 35 used for designating to display a display screen of the external data to be transmitted on the external data selection screen. The external data selection screen may be displayed near the respective transliteration tags on the transliteration work screen described with reference to FIG. 7.

The operator, then, selects the text to which the operator wants to add the transliteration setting mostly supported by the third parties out of the texts displayed on the external data selection screen by operation via the operation unit 7, and operates the generation button 35. In the example illustrated in FIG. 14, the check box is displayed for each text. The operator selects desired texts by adding checks to the corresponding check boxes via the operation unit 7, and operates the generation button 35.

When the generation button 35 is operated, the external data generation unit 32 extracts the transliteration settings of the transliteration tags selected by the operator from the transliteration history data read from the HDD 5. In the extraction, the duplicated transliteration settings may be excluded. After the extraction of the transliteration settings, the external data generation unit 32 supplies the respective texts selected by the operator and the extracted transliteration settings to the synthesized voice generation unit 15. The synthesized voice generation unit 15 converts the supplied texts and the transliteration settings into a format recognizable by a voice synthesis engine (e.g., a language in an SSML format). The synthesized voice generation unit 15 inputs the converted language to the voice synthesis engine to produce the synthesized voices.

Figure 15:
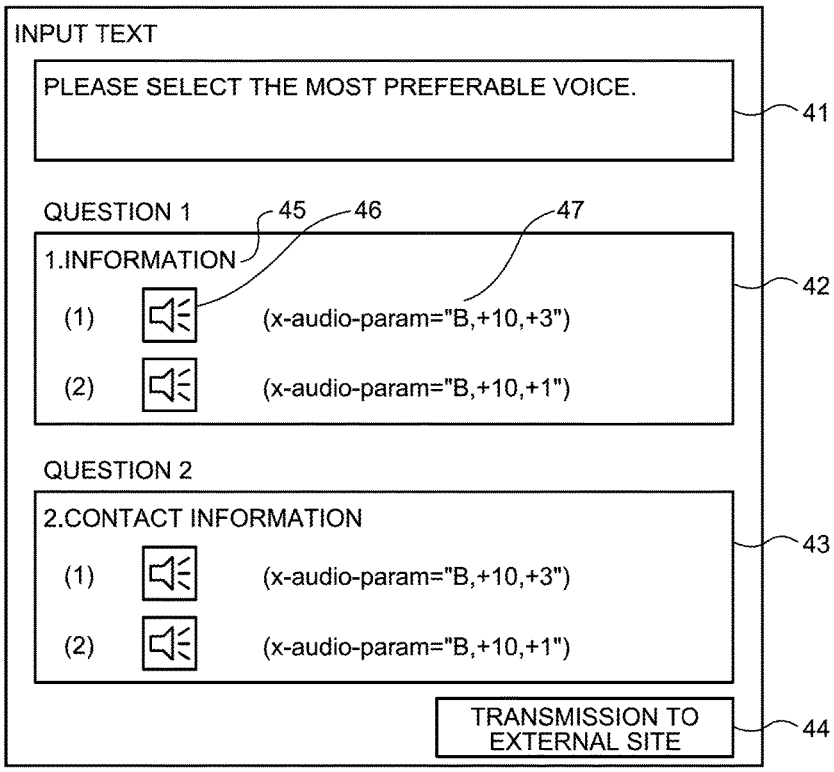
FIG. 15 is a diagram illustrating an exemplary external data generation screen displayed by the transliteration support device in the third embodiment.

After the synthesized voices are produced, the display controller 33 displays the external data generation screen illustrated in FIG. 15 on the display unit 6. In the example illustrated in FIG. 15, the display control unit 33 displays, on the external data generation screen, a message input section 41 used for the operator inputting a message and the like. The display control unit 33 displays, on the external data generation screen, question sections 42 and 43 used for the third parties selecting desired transliteration settings. The display control unit 33 displays, on the external data generation screen, a transmission button 44 used for instructing the transmission of the external data produced on the external data generation screen to the server on a certain network.

The display control unit 33 displays a text 45 corresponding to the question in each of the question sections 42 and 43, and displays a plurality of transliteration settings 47 set for the text 45. The display control unit 33 displays, in the respective question sections 42 and 43, reproduction buttons 46 each used for designating the reproduction of the synthesized voice corresponding to one of the transliteration settings of each text. The synthesized voice reproduced by the reproduction button 46 is the synthesized voice produced by the synthesized voice generation unit 15.

The operator checks the external data generation screen, and inputs a message in the message input section 41 or modifies the transliteration setting of a desired text if necessary. The operator, then, operates the transmission button 44 for transmission via the operation unit 7. The external data generation unit 32 produces a compressed file including the message input in the external data generation screen, the respective texts and the XML data of the transliteration settings of the respective texts, and the synthesized voices corresponding to the transliteration settings of the respective texts. XML is the abbreviation of "extensible markup language".

When the transmission button 44 is operated for transmission, the communication unit 4 illustrated in FIG. 1 transmits the compressed file produced by the external data generation unit 32 to the server on the certain network using Web API of the external service.

The third parties each access the server on the certain network and select a desired transliteration setting out of the multiple transliteration settings added to the text. The server transmits selection result information indicating the transliteration setting mostly selected by the third parties to the transliteration support device via the network (crowdsourcing). The selection result information is received by the communication unit 4. The received selection result information is displayed on the display unit 6 by the display control unit 33.

As a result, the operator can recognize the transliteration setting mostly instructed by the third parties for each text. The selection result information is supplied to the transliteration tag addition unit 12. The transliteration tag addition unit 12 sets the transliteration setting indicated by the selection result information to the corresponding text. As a result, the transliteration setting of the text desired by the operator can be set to be the transliteration setting instructed by many third parties.

Advantageous Effects of Third Embodiment

It is obvious from the above description that the transliteration support device in the third embodiment adds the transliteration setting instructed by many third parties to the text using crowdsourcing. The transliteration support device in the third embodiment, thus, can enhance transliteration quality and also obtain the same advantageous effects as the respective embodiments.

While the respective embodiments of the invention have been described, the respective embodiments have been presented by way of examples only, and are not intended to limit the scope of the invention. The novel respective embodiments described herein may be embodied in a variety of other forms. Furthermore, various omissions, substitutions, and changes of the embodiments described herein may be made without departing from the spirit of the invention. The accompanying claims and their equivalents are intended to cover the respective embodiments or the modifications as would fall within the scope and spirit of the invention.

What is claimed is:

1. A transliteration support device, comprising:

an acquisition unit that acquires a text to be transliterated;

an addition unit that adds a transliteration tag indicating a transliteration setting of the text to the text;

an extraction unit that extracts a transliteration pattern in which a frequent appearance transliteration setting frequently appearing in the transliteration settings indicated by the transliteration tags and an applicable condition when the frequent appearance transliteration setting is applied to the text are in association with each other;

a generation unit that produces a synthesized voice using the transliteration pattern;

a reproduction unit that reproduces the produced synthesized voice;

a storage unit that stores therein transliteration history data including an update time of each of the transliteration tags; and a calculation unit that calculates a transliteration reliability of each of the transliteration tags from the transliteration history data, wherein the extraction unit calculates a reliability of each transliteration pattern using the calculated transliteration reliability of each of the transliteration tags and extracts only the transliteration pattern having a reliability equal to or larger than a certain reliability.

2. The transliteration support device according to claim 1, wherein the extraction unit sets a certain element of the transliteration tag or a certain text format as the applicable condition, and extracts a transliteration pattern in which the applicable condition and the frequent appearance transliteration setting are in association with each other.

3. The transliteration support device according to claim 2, wherein the addition unit adds, as the transliteration tag, pause information instructing that the synthesized voice not be output, and the extraction unit extracts the transliteration pattern in which the certain text format and the transliteration setting of the pause information are in association with each other.

4. The transliteration support device according to claim 1, wherein the addition unit adds the transliteration tag that extends and describes a structured document tag to the text.

5. The transliteration support device according to claim 1, wherein the addition unit adds, as the transliteration tag, synthesized voice parameter information including a speaker, a volume, and a pitch, and the extraction unit extracts a transliteration pattern in which a frequent appearance element in the text and the synthesized voice parameter information added to the frequent appearance element are in association with each other.

6. The transliteration support device according to claim 1, wherein the addition unit adds, as the transliteration tag, reading information indicating a reading of the text, and the extraction unit extracts a transliteration pattern in which a frequent appearance element in the text and the reading information added to the frequent appearance element are in association with each other.

7. The transliteration support device according to claim 1, further comprising:

a storage unit that stores therein transliteration history data including an update time of each of the transliteration tags; and a calculation unit that calculates a transliteration reliability of each of the transliteration tag from the transliteration history data;

an external data generation unit that produces, from the transliteration history data and the transliteration reliability, external data used by a third party to select a desired transliteration setting out of a plurality of transliteration settings for the text an operator designates; and a communication unit that transmits the external data to a server on a certain network, which the third party accesses to select the desired transliteration setting, and receives a selection result of the transliteration setting by the third party, the selection result being transmitted from the server, wherein the addition unit adds the transliteration tag of the transliteration setting corresponding to the selection result by the third party to the corresponding text.

8. A transliteration support method, comprising:

acquiring a text to be transliterated;

adding a transliteration tag indicating a transliteration setting of the text to the text;

extracting a transliteration pattern in which a frequent appearance transliteration setting frequently appearing in the transliteration settings indicated by the transliteration tags and an applicable condition when the frequent appearance transliteration setting is applied to the text are in association with each other;

producing a synthesized voice using the transliteration pattern;

reproducing the produced synthesized voice;

calculating a transliteration reliability of each of the transliteration tags from transliteration history data including an update time of each of the transliteration tags stored in a storage unit, wherein the extracting calculates a reliability of each transliteration pattern using the calculated transliteration reliability of each of the transliteration tags and extracts only the transliteration pattern having a reliability equal to or larger than a certain reliability.

9. A computer program product comprising a non-transitory computer-readable medium that stores therein a transliteration support program that causes a computer to function as:

an acquisition unit that acquires a text to be transliterated;

an addition unit that adds a transliteration tag indicating a transliteration setting of the text to the text;

an extraction unit that extracts a transliteration pattern in which a frequent appearance transliteration setting frequently appearing in the transliteration settings indicated by the transliteration tags and an applicable condition when the frequent appearance transliteration setting is applied to the text are in association with each other;

a generation unit that produces a synthesized voice using the transliteration pattern;

a reproduction unit that reproduces the produced synthesized voice;

a calculation unit that calculates a transliteration reliability of each of the transliteration tags from transliteration history data including an update time of each of the transliteration tags stored in a storage unit, wherein the extraction unit calculates a reliability of each transliteration pattern using the calculated transliteration reliability of each of the transliteration tags and extracts only the transliteration pattern having a reliability equal to or larger than a certain reliability.

* * * * *